United States Patent [19]

Lancet et al.

[11] 4,440,546

[45] Apr. 3, 1984

[54] PROCESS FOR GASIFICATION OF CARBONACEOUS MATERIAL

[75] Inventors: Michael S. Lancet, Pittsburgh, Pa.; Everett Gorin, San Rafael, Calif.

[73] Assignee: Conoco Inc., Wilmington, Del.

[21] Appl. No.: 474,911

[22] Filed: Mar. 14, 1983

Related U.S. Application Data

[63] Continuation of Ser. No. 305,588, Sep. 25, 1981, abandoned.

[51] Int. Cl.[3] ..... C10J 3/14; C10J 3/16

[52] U.S. Cl. ..... 48/202; 48/206; 252/373

[58] Field of Search ..... 48/197 R, 202, 203, 48/206, 210; 252/373; 44/1 S, R, 10 R, 16 C, 16 E

[56] References Cited

U.S. PATENT DOCUMENTS

| | | | |
|---|---|---|---|
| 3,115,394 | 12/1963 | Gorin et al. | 48/202 |
| 3,884,649 | 5/1975 | Matthews | 48/202 |
| 4,226,601 | 10/1980 | Smith | 44/1 S R |
| 4,230,460 | 10/1980 | Maust | 44/1 S R |
| 4,248,605 | 2/1981 | Lancet | 48/197 R |

FOREIGN PATENT DOCUMENTS

| | | | |
|---|---|---|---|
| 2847416 | 5/1980 | Fed. Rep. of Germany | 48/206 |
| 1439317 | 6/1976 | United Kingdom | 48/206 |

OTHER PUBLICATIONS

Fink et al., "$CO_2$ Acceptor Process Pilot Plant-1974", *Clean Fuels From Coal Symposium* II Papers, IGT, 1975, pp. 243-257.

*Primary Examiner*—Peter F. Kratz

*Attorney, Agent, or Firm*—Dale Lovercheck; William A. Mikesell, Jr.

[57] ABSTRACT

A process of tar destruction in gasification of carbonaceous material comprising providing a mixture of finely divided calcium compound of a particle size smaller than 65 mesh and finely divided carbonaceous material of a particle size smaller than 65 mesh, the calcium compound to carbonaceous material ratio being from about 0.5 to 1.0 and contacting the mixture with $CO_2$ and tar exothermally whereby the tar is destroyed.

5 Claims, No Drawings

PROCESS FOR GASIFICATION OF CARBONACEOUS MATERIAL

This is a continuation of application Ser. No. 305,588 filed Sept. 25, 1981, now abandoned.

BACKGROUND OF THE INVENTION

Lancet et al in U.S. Pat. No. 4,231,760 discloses a gasification process using a synthetic $CO_2$ acceptor. Gasification occurs in a fluidized bed reactor. A product gas stream is recovered from the reactor. This product gas is passed to a solids gas separating means such as a cyclone from which the gaseous mixture is recovered and passed to further processing. The entrained solids being recovered and passed for recycle to the reactor.

Gorin in U.S. Pat. No. 2,654,661 discloses gasification of carbonaceous solid fuels wherein solids are separated from the gas product and recycled to the reactor.

Lancet in U.S. Pat. No. 4,248,605 discloses a gasification process using a fluidized bed wherein solids are separated from the gas product and subjected to treatment prior to being recycled to the fluidized bed reactor.

SUMMARY OF THE INVENTION

A process of tar destruction in gasification of carbonaceous material comprising providing a gasification feed mixture of finely divided calcium compound of a particle size smaller than 65 mesh and finely divided carbonaceous material of a particle size smaller than 65 mesh, the calcium compound to carbonaceous material ratio being from about 0.5 to 1.0 and catalytically gasifying the gasification feed mixture whereby the carbonaceous material is gasified to form a gaseous mixture comprising tar and carbon dioxide and heating the gasification feed mixture by exothermic reaction of the carbon dioxide and calcium compound whereby the tar is substantially destroyed from the gaseous mixture to form a gaseous product.

DETAILED DISCUSSION OF THE INVENTION

In the gasification of cabonaceous materials, the ggaseous product must be subjected to liquids gas separating means to remove tar from the gas products. This separation requires an additional processing step as well a an additional expense. Applicants' invention avoids both the additional processing step and the accompanying expense of providing a solids gas separating means for the gas product.

In the gasification reactor, the carbonaceous fuel reacts with steam injected from the lower end of the reactor to produce a gas which is rich in hydrogen. Typically the gas comprises hydrogen and carbon monoxide in a ratio approximately 3 mols of hydrogen per mol of carbon monoxide. This ratio is desirable for producing synthetic natural gas such as methane or the like. In the reactor, the reactions occurring can be shown as follows:

$$C+H_2O \rightarrow CO+H_2 \quad \text{I.}$$

$$CO+H_2O \rightarrow CO_2+H_2 \quad \text{II.}$$

$$CaO+CO_2 \rightarrow CaCO_3+HEAT \quad \text{III.}$$

Additional reactions occurring are the shift reaction $$CO+H_2O \rightarrow CO_2+H_2 \quad \text{IV.}$$

The formation of methane by reactions such as $$CO+3H_2 \rightarrow CH_4+H_2O \quad \text{V.}$$

and the removal of sulfur compounds by reactions such as $$CaO+H_2S \rightarrow CaS+H_2O \quad \text{VI.}$$

As is clear to those skilled in the art, a variety of reactions are occurring in the reactor and the net result may be the production of synthesis gas which is rich in hydrogen. The reaction of calcium oxide with carbon dioxide is exothermic and produces sufficient heat to maintain the desired temperature in the reactor. The calcium carbonate compounds removed from the bottom of a reactor for gasification may be regenerated as is known in the art. Reaction conditions in the gasification reactor are typically below 1550° F. with steam pressure in the standpipe underneath a typical reactor are controlled at values below about 13 atms. However, those skilled in the art will recognize that other values of operating temperature and pressure are within the ordinary skill and the invention is not limited to the exemplary temperatures and pressures discussed.

By means of the present invention, tars are destroyed in the top of the gasifier chamber so that the need for separating tar solids from the gas product is eliminated. The carbonaceous material being gasified in the gasifier reactor chamber may be finely divided bituminous coal from Eastern United States called Eastern coal of a particle size less than 65 Tyler mesh similarly, coke particles, tar sands or vacuum bottles each of a particle size less than 65 Tyler mesh may be used as the material to be gasified. The carbonaceous material is mixed with finely divided calcium compound. The finely divided calcium compound is preferably calcium oxide or calcium hydroxide of a particle size less than 65 Tyler mesh. The calcium compound and the carbonaceous material are mixed prior to being fed to the top of the gasifier. The ratio of calcium compound to carbonaceous material is in the range of 0.5 to 1.0. As mentioned, the reaction of calcium oxide with carbon dioxide (reaction III) is exothermic and produces sufficient heat to maintain the desired reaction temperature in the reactor. Within the range mentioned for the ratio of calcium compound to carbonaceous material, the heat provided by the exothermic reaction of calcium oxide and carbon dioxide is substantial enough to eliminate tars from the gas product leaving the top of the reactor. The tars are destroyed, for example by reaction II. As the calcium carbonate formed moves to the bottom of the gasifier it will be recalcinated to calcium oxide which can then be recovered and eventually reused in the process.

Preferably the particle size for the calcium compound is less than 100 Tyler mesh. Where the carbonaceous material is particulate the particle size of the solid carbonaceous material is preferably less than 100 Tyler mesh.

The gasifier may be operated at 1200° to 1500° F. in a tar destruction zone at the top where the mixture of calcium compound and carbonaceous materials is fed in. This temperature is produced by heat from reaction III. Lower in the gasifier catalyzed gasification occurs, for example by reactions I–V, in a catalyzed gasification zone.

Because of the intimate contact between the small particles of carbonaceous material and calcium compound in the mixture of solids, when the solids mixture is liquified to form a suspension of calcium compound in carbonaceous material, the distribution of calcium compound in the suspension of carbonaceous material is sufficient for catalysis of the gasification of carbonaceous material during heating.

The suspension of catalyzed carbonaceous material formed by the liquifying of a mixture of finely divided carbonaceous material and finely divided calcium compound form a coke product. This coke product may be gasified by any process which will accept coke or char as the feed. For example, the coke product may be briquetted and fed to a fixed bed gasifier such as those described at pages 1634 to 1639 of Elliott, Chemistry of Coal Utilization, Second Supplementary Volume, 1981. Alternatively, the product of the present invention may be fed by a screw-type feeding system as the gasifier fuel such screw-type feeder is shown in Fernandes, U.S. Pat. No. 3,920,417. During gasification the mixture of carbonaceous material and calcium compound may be contacted with molecular oxygen or air or steam or mixtures of the aforesaid air, oxygen and steam.

Within the scope of the invention is a gasification process using a feed product having a carbonaceous suspension of calcium compound made by heating a mixture of finely divided carbonaceous particles of a size smaller than 65 mesh and finely divided calcium compound particles of a size smaller than 65 mesh. The calcium compound is preferably a compound of calcium selected from a group consisting of calcium oxide, and calcium hydroxide. More preferably the particle size of both the finely divided carbonaceous material and the finely divided calcium compound is smaller than 100 mesh. Especially preferably the particle size of the finely divided calcium compound and the finely divided carbonaceous material is less than 200 mesh. Most preferred is finely divided calcium compound of particle size less than 325 mesh.

Mixtures of −65 mesh about 50% finely divided carbonaceous material and about 50% finely divided calcium compound produce sufficient heat in the top of the gasifier to destroy tars which would leave the gasifier with the product gas and require additional processing to separate them.

EXAMPLE 1

Ten pounds of Eastern U.S. coal is ground to −65 Tyler mesh. Ten pounds of calcium oxide is ground to −200 Tyler mesh. The finely divided Eastern U.S. coal and finely divided calcium oxide are mixed and then briquetted. The briquettes are conveyed to the top of a gasifier where the calcium oxide reacts with $CO_2$ to produce heating to 1500° F. The briquettes melt, forming an intimate calcium-melted coal suspension which upon coking formed a catalyzed char. This catalyzed char is then gasified upon moving down the bed forming a gaseous mixture comprising $CO_2$, tar and $H_2$. The gasification gaseous product leaving the top of the gasifier is lowered in tar by high temperature tar destruction in the top of the gasifier.

EXAMPLE 2

Ten pounds of Eastern U.S. coal is ground to −65 Tyler mesh. Ten pounds of calcium oxide is ground to −200 Tyler mesh. The finely divided Eastern U.S. coal and finely divided calcium oxide are mixed. This mixture is extruded into the top of a gasifier where the calcium oxide reacts with $CO_2$ to produce heating to 1500° F. The extrudate is melted, forming an intimate calcium-melted coal suspension which upon coking formed a catalyzed char. This catalyzed char is then gasified upon moving down the bed forming a gaseous mixture comprising $CO_2$, tar and $H_2$. The gasification gaseous product leaving the top of the gasifier is lowered in tar by high temperature tar destruction in the top of the gasifier.

While the present invention has been disclosed by reference to certain of its preferred embodiments it is pointed out that the embodiment set forth are illustrative rather than limiting in nature and that many variations and modifications are possible within the scope of the present invention. Many such variations and modifications may be considered obvious or desirable to those skilled in the art based upon a review of the foregoing description of preferred embodiments.

What is claimed is:

1. A process for producing a tar free gaseous product comprising hydrogen and carbon monoxide by catalyzed gasification of bituminous coal consisting of the steps as follows:

(a) providing a mixture consisting essentially of finely divided bituminuous coal particles of a size of 65 mesh or smaller than 65 mesh and finely divided calcium oxide particles of a size smaller than 100 mesh, said calcium oxide and said bituminuous coal being in intimate contact and in a weight ratio of about 0.5 to 1.0, said bituminous coal having the property of becoming liquid with sufficient heating, and said bituminous coal yielding tar when sufficiently heated, (b) briquetting said mixture to form a briquetted mixture, (c) feeding said briquetted mixture into the top of a fixed bed gasifier, (d) catalytically gasifying said briquetted mixture with steam in said gasifier to form gaseous mixture comprising tar, carbon dioxide, hydrogen and carbon monoxide, said hydrogen and said carbon monoxide each comprising a substantial portion of said gaseous mixture, said gasifying comprising (i) heating said briquetted mixture of finely divided coal and finely divided calcium oxide in said fixed bed gasifier to form a catalyzed coke, said catalyzed coke reacting with said added steam to form said gaseous mixture and, (ii) adding steam to said gasifier, (e) destroying said tar in a tar destruction zone at the top of said gasifier to form a tar free gaseous product, by operating said tar destruction zone above 1200° F., the heat for tar destruction being provided by exothermic reaction of said calcium oxide and said carbon dioxide, said tar free gaseous product comprising hydrogen and carbon monoxide each in substantial proportion, whereby said calcium oxide catalyzes said gasification to form said tar free gaseous product, the rate of said catalyzed gasification being substantially increased from the rate of uncatalyzed gasification of said bituminuous coal, said tar being eliminated by sufficient heat of reaction of said calcium oxide and said carbon dioxide to maintain said tar destruction zone above 1200° F. to cause destruction of said tar during gasification.

2. The process of claim 1 wherein said tar is destroyed in said tar destruction zone at the top of said gasifier operating at 1200 to 1500° F.

3. The process of claim 1 wherein said calcium oxide has a particle size less than 200 Tyler mesh.

4. The process of claim 3 wherein said coal has a particle size smaller than 100 Tyler mesh.

5. The process of claim 1 wherein said calcium oxide particle size is smaller than 325 Tyler mesh.

* * * * *